United States Patent [19]

Trammell

[11] 4,244,485

[45] Jan. 13, 1981

[54] COLLAPSIBLE BASKET

[76] Inventor: Louis T. Trammell, 202 Butler Ave., Buffalo, N.Y. 14208

[21] Appl. No.: 804,944

[22] Filed: Jun. 9, 1977

[51] Int. Cl.[3] ..... B65D 6/16

[52] U.S. Cl. ..... 220/6; 220/19; 150/49

[58] Field of Search ..... 220/6, 8, 19, 7; 150/48, 49, 50, 51

[56] References Cited

U.S. PATENT DOCUMENTS

| | | | |
|---|---|---|---|
| 1,507,977 | 9/1924 | Schaefer | 220/6 |
| 2,246,580 | 6/1941 | Farmer | 220/19 |
| 2,797,011 | 6/1957 | Boersma et al. | 150/49 X |
| 2,848,032 | 8/1958 | Nist | 150/48 |

FOREIGN PATENT DOCUMENTS

| | | | |
|---|---|---|---|
| 227474 | 9/1943 | Switzerland | 150/49 |

*Primary Examiner*—Steven M. Pollard
*Attorney, Agent, or Firm*—Christel, Bean & Linihan

[57] ABSTRACT

A collapsible basket having an upper generally rectangular frame with side and end rail portions. The side rail portions comprise a plurality of telescoping sections whereby the lengths of the side rail portions may readily be extended or retracted. The bottom wall of the basket consists of a lazy tong linkage lying generally in a plane parallel to the plane of the upper frame and is therefore extensible and retractible in a lengthwise direction. A series of flexible strap members are spaced about the upper frame and extend downwardly to and are connected with the ends of the links of the lazy tong bottom wall structure. The upper ends of the strap members have loops which extend about and are slideable along the side rails of the upper frame of the basket.

2 Claims, 5 Drawing Figures

Fig. 1.
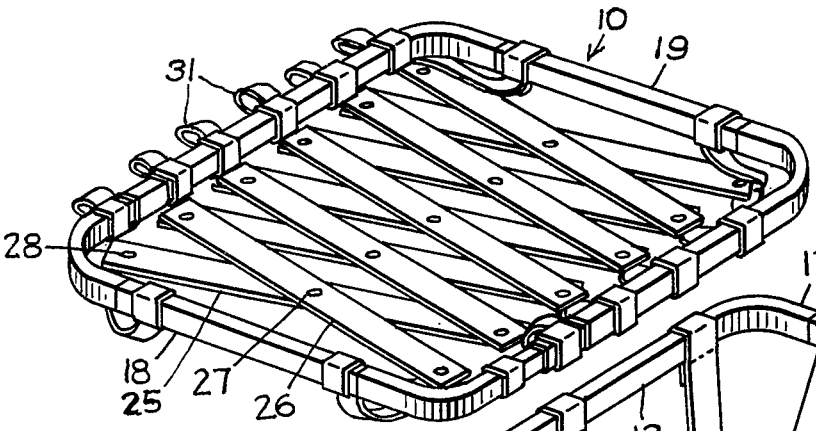
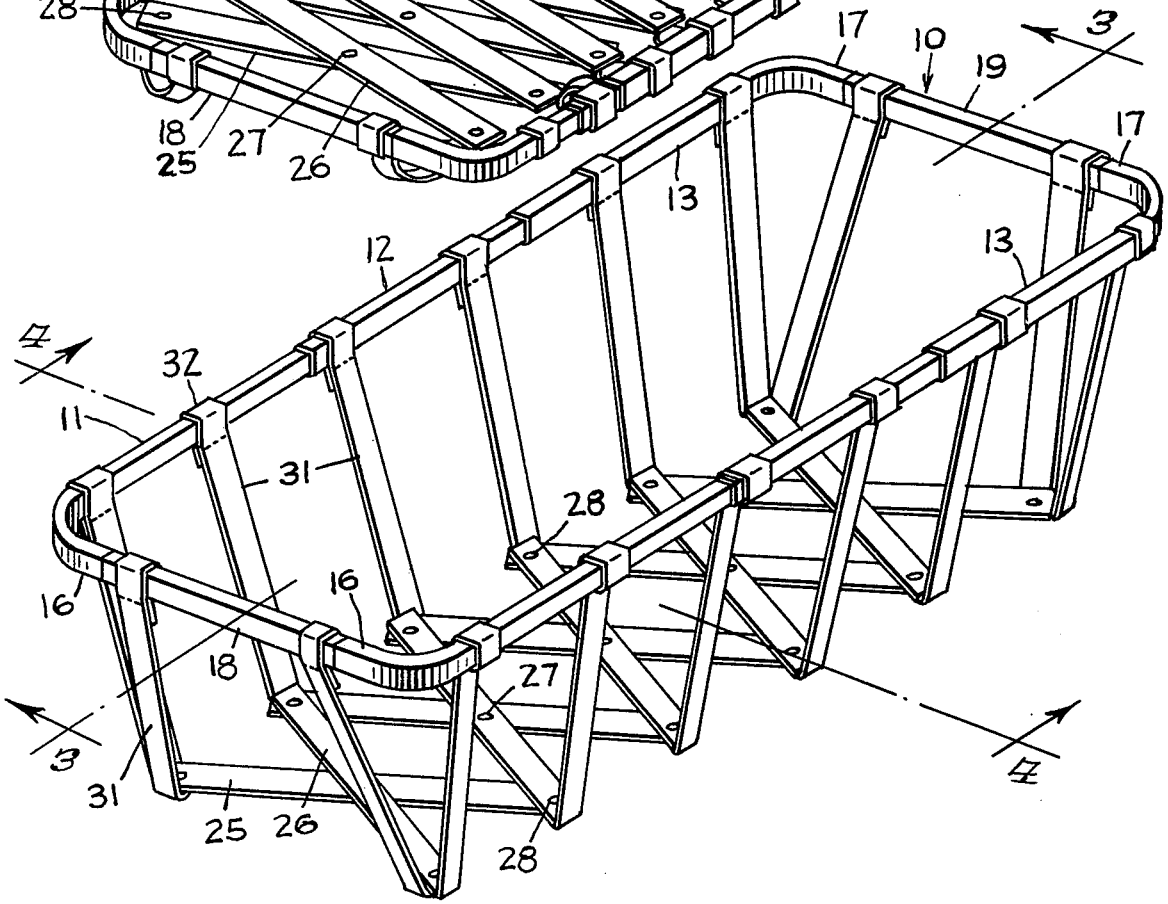
Fig. 2.

COLLAPSIBLE BASKET

BACKGROUND OF THE INVENTION

This invention relates to collapsible baskets which are relatively flat and of minimal length when in a folded or collapsed condition but which are readily openable to full depth and length for convenient use.

Many forms of collapsible baskets have been proposed in the past but none of the prior art baskets of this general type has met wide acceptance. Many of the collapsible baskets of the prior art are relatively flimsy and insubstantial when opened up for use. Others have probably failed to gain wide acceptance do to cost of manufacture or failure to stand up in normal use. Other prior art collapsible baskets have proved to be unduly complex from a mechanical standpoint and therefore difficult to adjust readily between open condition for use and closed or collapsed condition for storage.

Shoppers in supermarkets are often presented with a problem in transferring their purchases from supermarket carts to their automobiles or in carrying their purchases from the supermarket to their homes or some other point. This problem is increased by the fact that, do to frequent thefts, supermarkets frequently have arrangements which prevent the carts from being moved from the immediate vicinity of the supermarket. The basket of the present invention is especially useful in this general situation.

SUMMARY OF THE INVENTION

In the basket of the present invention a generally rectangular top frame structure is provided in which the side rails of the frame consist of telescoping portions which are readily extended to form a full open rectangular frame or collapsed to reduce the length of the frame structure to a fraction of the opened length thereof. The bottom of the basket of the present invention comprises a lazy tong or parallel linkage mechanism which is extensible to the full length of the basket in open position or collapsible to a fraction of that length, that is, somewhat commensurate with the collapsed length of the upper frame structure.

The upper frame structure and the bottom lazy tong wall structure are connected by a series of generally flexible tapes or strips of material which extend substantially vertically between the upper rectangular frame member and the bottom wall lazy tong structure of the basket. The upper ends of the strips have loops which extend about and are slideable along the rail portions of the upper frame member and the lower ends of the strips are attached to the lazy tong structure preferably at the points where the outer ends of the several links of the lazy tong structure are pivoted to each other.

BRIEF DESCRIPTION OF THE DRAWINGS

FIG. 1 is a perspective view of one form of the basket of the present invention shown in a collapsed or folded condition;

FIG. 2 is a perspective view of the basket of FIG. 1 shown in an open or extended position;

DESCRIPTION OF THE ILLUSTRATED EMBODIMENT

Figure 3:
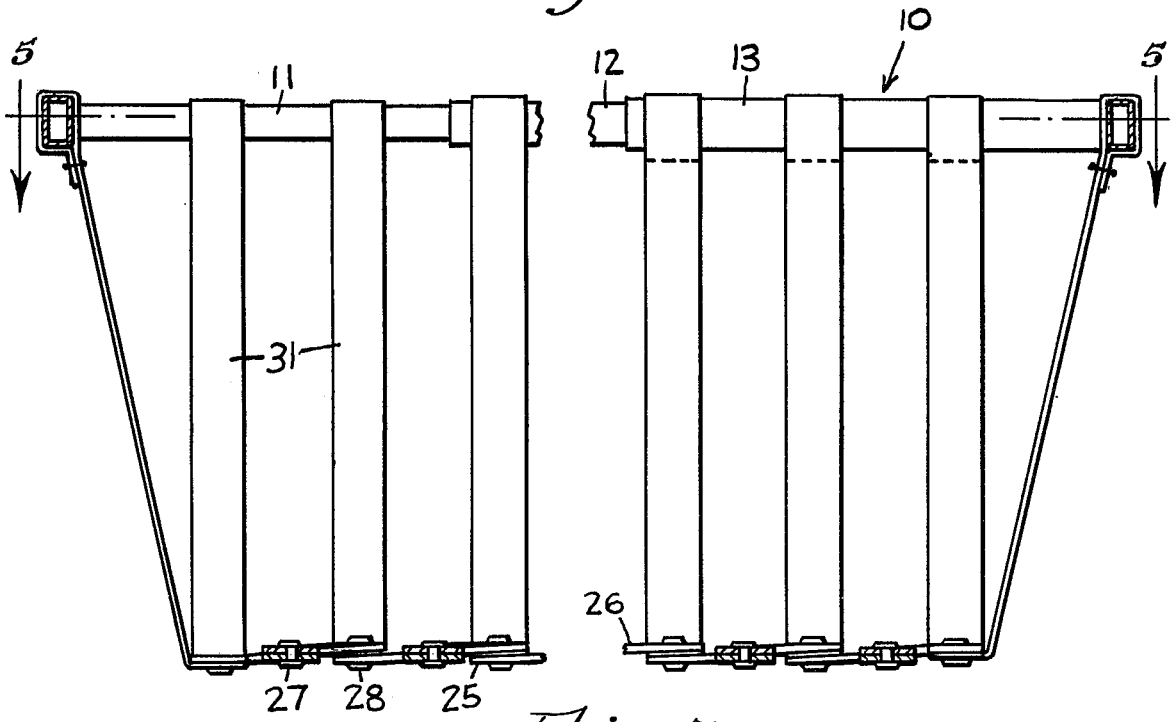
FIG. 3 is a longitudinal cross sectional view taken approximately on the line 3—3 of FIG. 2.
Figure 4:
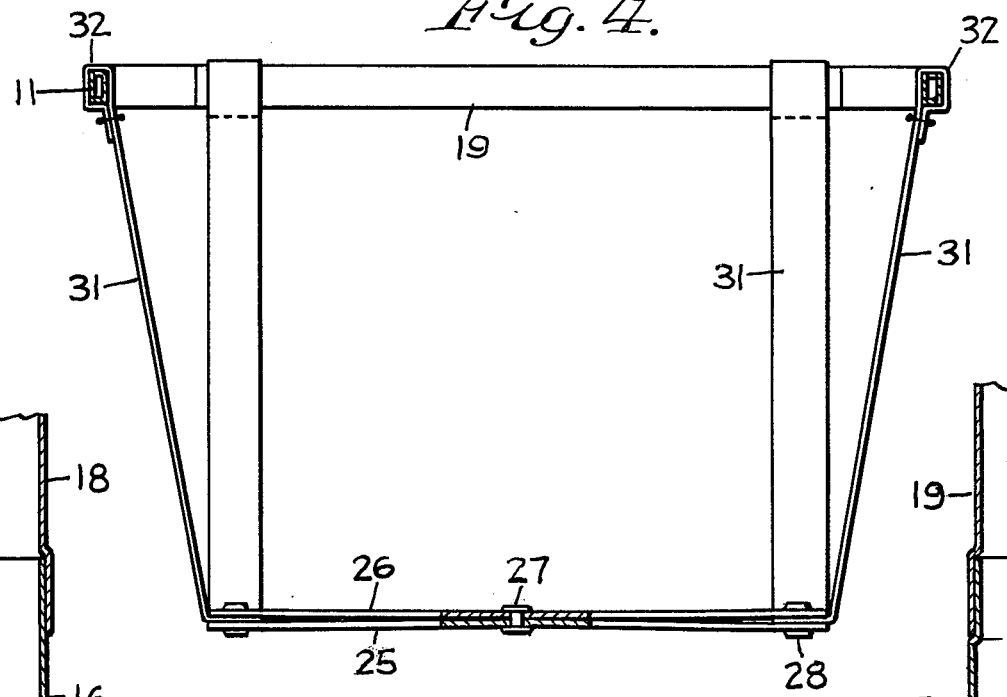
FIG. 4 is a transverse cross sectional view taken approximately on the line 4—4 of FIG. 2.

The basket illustrated in the drawings by way of example comprises an upper horizontally extending rectangular frame structure designated generally by the numeral 10. Each horizontal side rail of the frame 10 comprises three telescoping tubular members designated 11, 12 and 13, respectively.

The side rail members 11 and 13 have curving end portions 16 and 17, respectively, which terminate generally at right angles to the side rail structure. End rails 18 and 19 fit over the ends of the terminal portions 16 and 17 of the side rail members 11 and 13 and are secure thereto in any desired manner.

Figure 5:
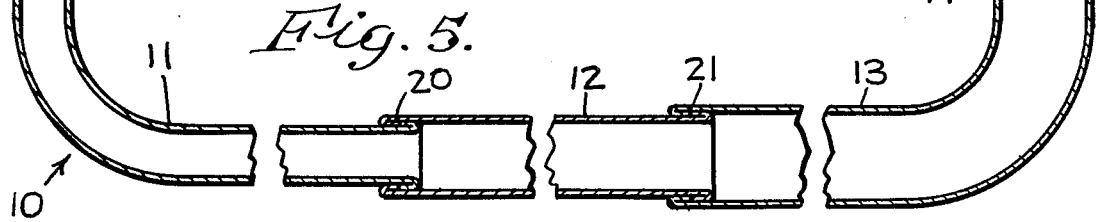
FIG. 5 is a fragmentary cross sectional view of the upper frame portion taken on the line 5—5 of FIG. 3.

As clearly shown in FIG. 5, side rail member 11 is slideable in side rail member 12 and side rail member 12 is slideable in side rail member 13. The side rail members 11 and 12 have return bent end portions 20 and 21, respectively, which engage flanges at the ends of the rail members 12 and 13 to prevent their disassembly from the side rail members 12 and 13, respectively. If desired the two side rail members 11 may be integral with end rail 18 and the two side rail members 13 may be integral with end rail member 19.

From the foregoing it will be seen that the upper rectangular frame 10 may readily be extended to the full open position shown in FIG. 2 or may be contracted to the collapsed position shown in FIG. 1.

The bottom of the basket is formed by a longitudinal series of generally parallel cross links 24 and 25 which are pivotally connected in pairs at their midpoints as indicated at 27 and which have their respective ends pivotally connected as at 28 to form a lazy tong or parallel linkage structure.

The sides of the basket are formed by strips of flexible but relatively stout canvas or webbing 31. Each of the webbing strips 31 has a loop as at 32 at its upper end which fits slideably on the upper rail structure and the lower end of each webbing strip 31 is attached to the pivoted ends of the links 25 and 26 which lie beneath each such strip 31.

From the foregoing it will be seen that, with the basket in the collapsed position shown in FIG. 1 in which it is kept not in use so that it may readily be carried about as in an automobile or the like, a user merely grasps the end rails 18 and 19 and pulls them apart. The tension of the end straps 31 applies an extending force on the lazy tong bottom structure to extend the same so that the basket is then presented in the fully open position of use illustrated in FIG. 2.

A preferred embodiment of the present invention has been described herein and illustrated in the accompanying drawings by way of example. However, it is to be understood that numerous modifications thereof may be made without departing from the broad spirit and scope of the invention as defined in the appended claims.

I claim:

1. In a collapsible basket, an upper generally rectangular frame having side and end rail portions, the side rail portions comprising a plurality of telescoping sections whereby the lengths of the side rail portions may be extended or retracted in a lengthwise direction, a bottom wall comprising a lazy tong linkage lying generally in a plane parallel to the plane of said upper frame and extensible and retractable in a lengthwise direction with said rail portions, and a series of flexible strap members spaced about said upper frame and extending downwardly to and connected with the pivotal connections of the outer ends of the links of the lazy tong linkage of said bottom wall, the upper ends of the strap members at the sides of said basket having loops extending about said rail portions and slidable therealong, said flexible strap members enabling said upper frame to be moved toward and away from said bottom wall between collapsed and opened positions of said basket, the overall thickness of said basket in a collapsed position being substantially no greater than the thickness of said rectangular frame.

2. A collapsible basket according to claim 1 wherein at least one of said straps extends downwardly from each of said end rail portions to engagement with end portions of said bottom wall lazy tong linkage to extend the latter upon extension of said upper frame.

* * * * *